US009789016B2

(12) United States Patent
Warren et al.

(10) Patent No.: US 9,789,016 B2
(45) Date of Patent: Oct. 17, 2017

(54) LIGHTWEIGHT FOLDABLE PATIENT LITTER

(71) Applicant: Physical Sciences, Inc., Andover, MA (US)

(72) Inventors: Peter A. Warren, Newton, MA (US); David J. Shane, Boston, MA (US)

(73) Assignee: Physical Sciences, Inc., Andover, MA (US)

( * ) Notice: Subject to any disclaimer, the term of this patent is extended or adjusted under 35 U.S.C. 154(b) by 161 days.

(21) Appl. No.: 14/711,286

(22) Filed: May 13, 2015

(65) Prior Publication Data

US 2016/0331605 A1 Nov. 17, 2016

(51) Int. Cl.
*A61G 1/013* (2006.01)
*A61G 1/052* (2006.01)
*A61G 1/044* (2006.01)

(52) U.S. Cl.
CPC ..... *A61G 1/013* (2013.01); *A61G 1/044* (2013.01); *A61G 1/052* (2013.01)

(58) Field of Classification Search
CPC ..... A61G 1/013; A61G 1/052
USPC ..... 5/110–117, 625–629
See application file for complete search history.

(56) References Cited

U.S. PATENT DOCUMENTS 2,360,371 A 10/1944 Schwichtenberg
3,555,578 A 1/1971 Pile
3,886,606 A * 6/1975 Bradford ..... A61G 1/013 403/102
5,265,289 A * 11/1993 Swiger ..... A47D 5/006 190/2
6,842,923 B1 1/2005 Castellani et al.
7,043,785 B2 5/2006 Dimentmen
7,661,159 B1 * 2/2010 Chen ..... A47C 17/72 5/110
8,832,876 B1 * 9/2014 Oh ..... A47C 17/64 5/116
2009/0249546 A1 * 10/2009 Yul ..... A47C 17/72 5/115

(Continued)

FOREIGN PATENT DOCUMENTS

GB 1430597 A * 3/1976 ..... A61G 1/007

OTHER PUBLICATIONS

U.S. Army Aeromedical Research Laboratory (USAARL), U.S. Air Force Aeromedical Branch (ASC/WNUP) Joint Enroute Care Equipment Test Standard, http://www.dmsb.mil/refDocs/JECETS-Joint%20Airworthiness.pdf, Mar. 1, 2012, 33 pages.

*Primary Examiner* — Robert G Santos
*Assistant Examiner* — Myles Throop
(74) *Attorney, Agent, or Firm* — Iandiorio Teska & Coleman, LLP

(57) ABSTRACT

A lightweight flexible patient litter includes, in one example, spaced compression longerons each foldable at spaced legs, a bed between the compression longerons, and a longitudinal truss structure on each side of the litter each including a longeron, its spaced legs, and one or more flexible tension members connected thereto. One or more lateral truss structures may each include opposing legs on each side of the litter and one or more flexible tension members connected thereto. A bed truss structure may include one or more tension members.

22 Claims, 10 Drawing Sheets

(56) References Cited

U.S. PATENT DOCUMENTS

2010/0138999 A1* 6/2010 Westmoreland, II .. A61G 1/013
5/627

* cited by examiner

LIGHTWEIGHT FOLDABLE PATIENT LITTER

FIELD OF THE INVENTION

The invention relates to patient litters.

BACKGROUND OF THE INVENTION

In medical emergencies and even in routine care it is often necessary to transport a patient from the location of the accident or injury to a place of medical care. This transport can take place in several stages, often starting with hand carrying by medical workers, then transitioning to a ground or air vehicle. During these different modes of transport, the patient must be secured under varying types of accelerations and loading. The types of loading include both handling loads and vehicle accelerations. During transport by hand, the loads are typically vertical and lateral jostling with the loads being supported at the litter handles. During transport by vehicle, the highest loads are forward and lateral generated by vehicle accidents with the loads being supported by the litter-to-vehicle restraints.

In addition to supporting the weight of the patient and the associated medical gear through the transportation loads, the litter must fold compactly when it is not being used. Current litter technology is based on frame structures. Frame structures are structures in which the majority of the loads are carried through bending of local components. These bending loads result in local stress concentrations which must be accommodated with additional structural material, resulting higher overall litter weight.

The military has long used the foldable "Talon" litter which includes two spaced foldable longerons supporting a bed and interconnected by foldable bars. Because such a litter is based on a framed structure, it is relatively heavy. Moreover, in testing, the litter fails when subject to high accelerations. Various other litter designs are shown in U.S. Patent Application and Publication Nos. U.S. 2010/0138999; U.S. Pat. Nos. 3,886,606; 6,842,923; 7,043,785; 2,360,371; and 3,555,578 all incorporated herein by this reference.

SUMMARY OF THE INVENTION

The present invention relates to an unfoldable litter that forms a lightweight truss structure to support the patient's weight both during nor anal transport and in the event of an accident of the transporting vehicle. Truss structures are more weight efficient than frame structures because the predominant loads are supported in compression and tension rather than in bending. The direction of the loading from weight of the patient allows several of the truss elements can be made of flexible materials allowing for more compact packaging and lighter overall litter weight. The forces required to restrain the patient to the litter are best transferred directly to the restraints that hold the litter to the transport vehicle.

The subject invention preferably utilizes a series of truss structures to support the loads applied by the patient's weight as the patient is transported both by hand and by vehicles. The truss structures translate the applied loads into tension and compression loads in the individual elements. By avoiding global bending loads, the individual components have evenly spread and predictable stresses. This allows the component elements to be smaller, thinner, and made of lighter materials. The reduced component size reduces the packaged size. The combination of reduced size and lighter materials reduces the weight of the litter required to support a given set of patient mass and accelerations.

To further reduce the weight and stowed volume, the subject invention also takes advantage of the observation that in litters, some of the applied loads are always in the same direction. This directionality means that some of the elements are always in tension and never in compression. This, in turn, means that these components can made of flexible, high strength-to-weight materials such as aramids and Ultra-high-molecular-weight polyethylene. The use of these flexible, high strength elements, allow the further reduction of the stowed size and the overall system weight.

In an analysis of the loads experienced by a military litter, the observation is that the highest accelerations that are seen are during aircraft and ground vehicle accidents. During transport by the vehicles, the litters are restrained and the patient is, in turn, restrained by the litter. In current litter technology, the litter-to-vehicle restraint attaches to a different location than the litter-to-patient restraint. This results in substantial loads being transferred through the litter structure and designing for this load transfer adds substantial system mass. In contrast, the subject invention co-locate of the litter-to-vehicle restraint interface and the litter-to-patient restraint interface. This nearly direct load transfer reduces the loads applied to the litter structure reducing the mass of material that must be incorporated into the design.

Featured is a lightweight foldable patient litter comprising spaced compression longerons each foldable at, for example, first, second, and third spaced legs and a bed between the compression longerons. A longitudinal truss structure on each side of the litter includes a compression longeron and a flexible tension member extending from at or proximate one end of the compression longeron to at or proximate the bottom of each leg and then to an opposing end of the compression longeron.

Each longitudinal truss structure may further include a diagonal flexible tension member between the second leg and the first leg and between the second leg and the third leg. The diagonal flexible tension members preferably extend from at or proximate the bottom of the second leg to at or proximate the top of the first and third legs.

The litter may further include one or more lateral truss structures including opposing legs on each side of the litter. One lateral truss structure may include a foldable compression bar pivotably connected to each opposing leg, a flexible tension member extending from at or proximate the bottom of one leg across the litter to at or proximate the bottom of an opposing leg, and diagonal flexible tension members extending from at or proximate the bottom of one leg diagonally across to at or proximate the top of an opposing leg. The lateral truss structure may further include a flexible tension member extending from at or proximate the top of one leg across the litter to at or proximate the top of an opposing leg. In one design, there is a lateral truss structure between each pair of opposing legs.

The litter may further include a foldable compression bar pivotably connected between the spaced compression longerons on each end of the bed and a bed truss structure defining bed truss panels between adjacent foldable compression bars. Each panel may include flexible diagonal tension members.

The litter may further include a handle on each end of the compression longeron extending beyond the bed. Preferably a patient restraint is connected to nodes of a litter truss structure and a litter restraint is connected to the same nodes.

Also featured is a longitudinal truss structure on each side of a litter including a foldable compression longeron, a plurality of legs, and flexible tension members extending from at or proximate one end of a compression longeron to at or proximate the bottom of each leg and then to an opposing end of the longeron and one or more lateral truss structures between opposing legs of the litter.

In one preferred example, a patient litter includes spaced compression longerons each foldable at spaced legs, a bed between the compression longerons, a longitudinal truss structure on each side of the litter each including a longeron, its spaced legs, and one or more flexible tension members connected thereto, one or more lateral truss structures each including opposing legs on each side of the litter and one or more flexible tension members connected thereto, and a bed truss structure including one or more tension members.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
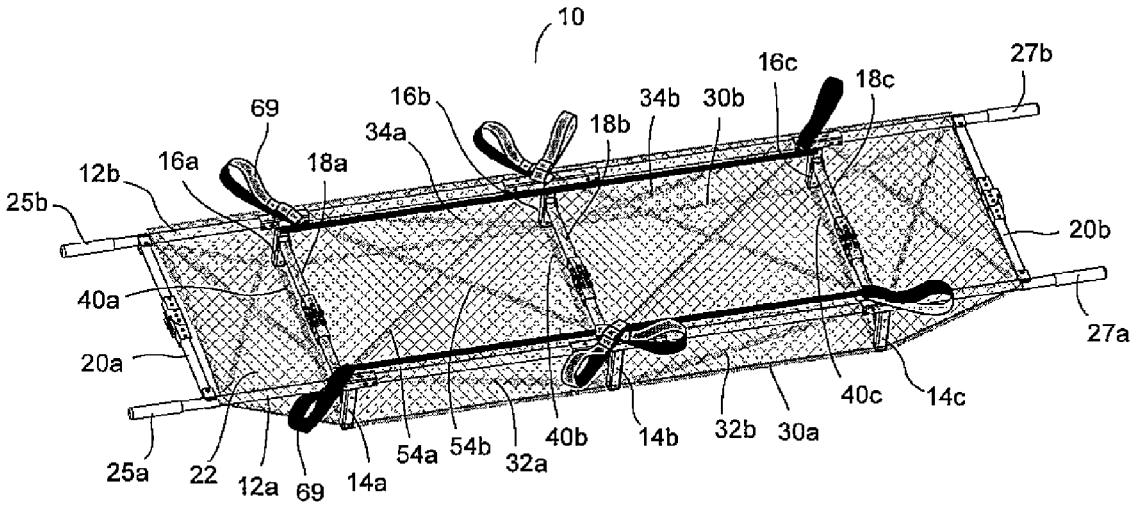
FIG. 1 is a schematic three dimensional top view of a litter in its deployed state in accordance with an example of the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
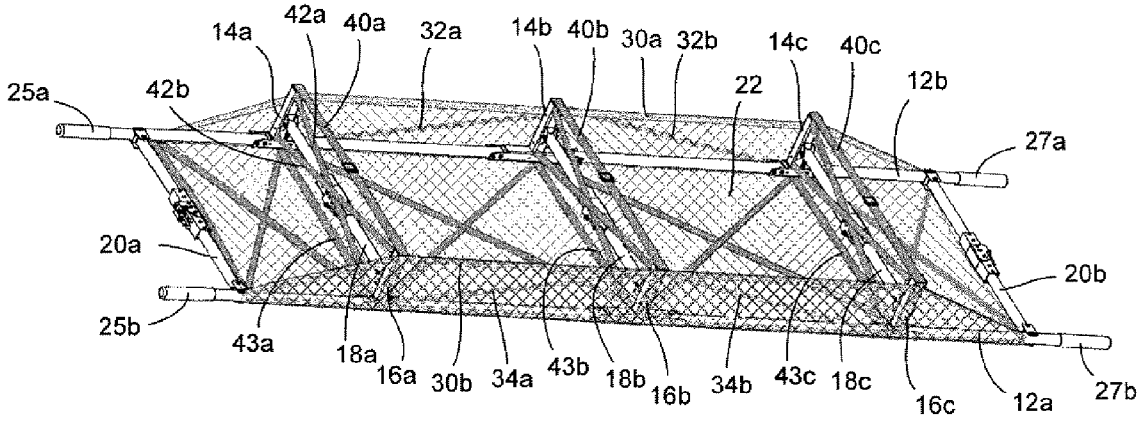
FIG. 2 is a schematic three dimensional view of the bottom of the litter shown in FIG. 1.

Litter 10, FIGS. 1-2, in one example, includes spaced compression longerons 12*a*, 12*b* each foldable at three legs as shown for longeron 12*a* foldable at legs 14*a*, 14*b*, and 14*c*. The legs may also fold inwardly with respect to their associated longeron. Or, the legs could be rigidly attached to the longeron. Longeron 12*b* is foldable at legs 16*a*, 16*b*, and 16*c*. Foldable compression bars are pivotably connected across opposing legs. Thus, compression bar 18*a* is pivotably connected between legs 14*a* and 16*a*, foldable compression bar 18*b* is pivotably connected between legs 14*b* and 16*b*, and foldable compression bar 18*c* is pivotably connected between legs 14*c* and 16*c*. Preferably, outer foldable compression bars or struts 20*a* and 20*b* are pivotably connected between compression longerons 12*a* and 12*b* at each end of bed 22 as shown. Bed 22 may be a mesh style as shown or solid fabric and it is typically affixed to or wrapped around the longerons. Various pivoting and foldable linkages may be used and locking joints may also be used for the longerons, legs, and compression bars which may be made of aluminum tubing, other metal alloys, or composite materials. Handles 25*a*, 25*b*, and 27*a*, and 27*b* are preferably included and may connect seamlessly to the respective longerons and extend outwardly from the bed for transporting a patient. The handles could also fold and/or telescope with respect to the longerons.

One or more truss structures are configured to support loads applied by the patient's weight. By utilizing a series of truss structures to support the loads applied by the patient's weight as the patient and the litter are transported both by hand and vehicles enables the truss structures to translate the applied loads into tension and compression loads in the individual truss structure elements. By avoiding global bending loads, the individual components have evenly spread and predictable stresses. This allows the component elements to be smaller, thinner, and made of lighter materials. The reduced component size reduces the folded package size. The combination of reduced size and lighter materials reduced the weight of the litter required to support a given set of patient mass and accelerations. The military and other users are is in need of lighter, portable, foldable litters and weight reductions, in particular, are important for man packable litters and litters transported via aircraft.

Shown in FIGS. 1-4 is an exemplary longitudinal truss structure on each side of the litter including a compression longeron 12 and flexible tension members (e.g., Kevlar, straps, belts, or webbing) extending from at or proximate one end of each compression longeron to at or proximate the bottom of each leg and then to an opposing end of the compression longeron. Thus, flexible tension member 30*a* is fixed to longeron 12*a* proximate bar 20*a* and the head of the bed, extends to the bottom of leg 14*a* (where it is affixed thereto), extends to the bottom of leg 14*b* (where it is affixed thereto), extends to the bottom of leg 14*c* (where it is affixed thereto) and then extends to proximate bar 20*b* and the foot of the bed where it is affixed to longeron 12*a*. Flexible tension member 30*b* is similarly constructed for longeron 12*b*.

Figure 3:
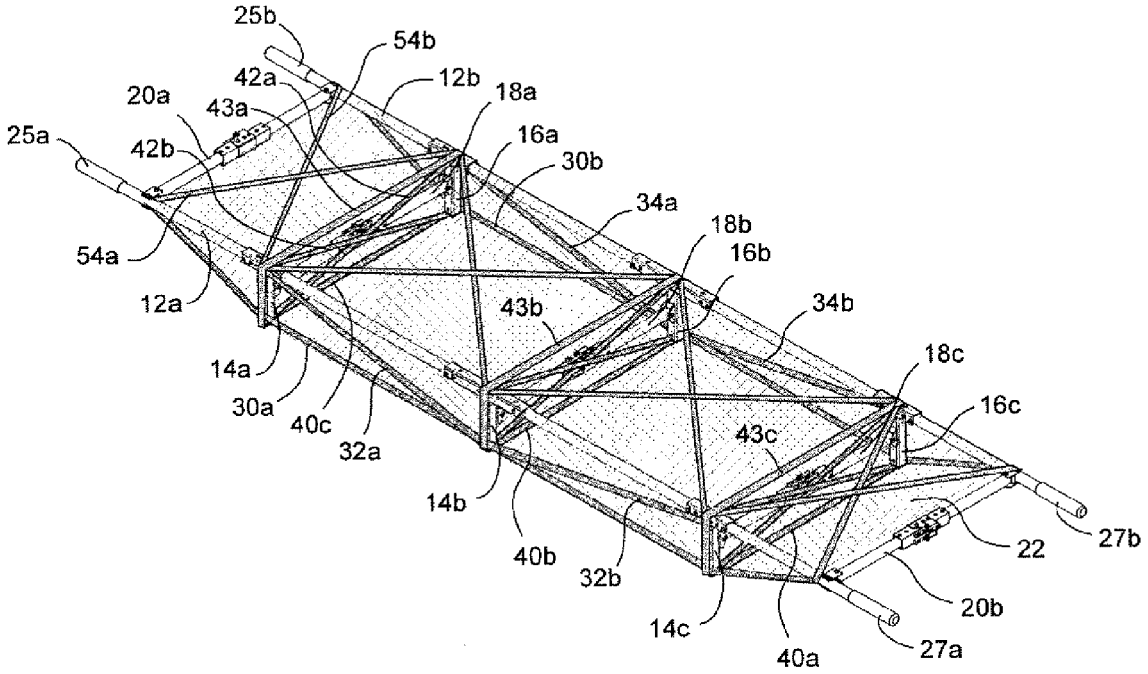
FIG. 3 is another schematic three dimensional view of an example of a litter.
Figure 4:
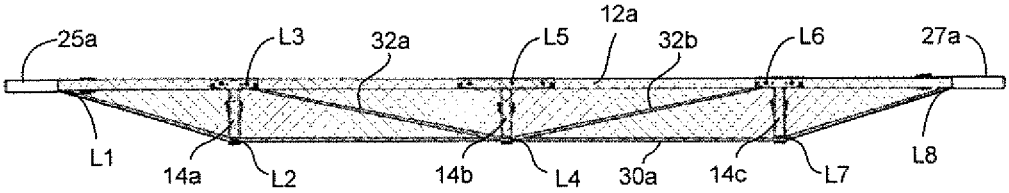
FIG. 4 is a schematic side view of a litter showing the longitudinal truss structure thereof.

Preferably, the nodes $L_1$-$L_8$ FIG. 4 of the longitudinal trusses are further connected by diagonal flexible tension members as shown for diagonal flexible tension member 32*a* extending diagonally from at or proximate the bottom of leg 14*b* to at or proximate the top of leg 14*a* and flexible tension member 32*b* extends diagonally from at or proximate the bottom of leg 14*b* to at or proximate the top of leg 14*c*. Flexible diagonal tension members 34*a*, and 34*b*, FIG. 3, are similarly connected between leg 16*b* and legs 16*a* and 16*c* on the other side of the litter completing its longitudinal truss structure. These diagonal elements prevent the structure from shearing under load. The flexible tension members cannot support bending or compression loads, and instead only support loads in tension. As such, they enable the litter to be folded and enable a lighter weight litter.

The resulting longitudinal truss structure enables the applied downward loads to be supported by components either entirely in either compression or tension with only the handles having to support a bending load. The outermost compression bars terminate at the handles so the litter can be carried by lifting at both ends or dragging by lifting at one end.

In sharp contrast, the litter of U.S. Pat. No. 2,360,371 has elements loaded in bending and the litter shown in U.S. Pat. No. 3,555,578 results in an incomplete truss structure with outer nodes and rail elements still loaded in bending and which thus must therefore be made larger and heavier to prevent deformation. The litter design shown in U.S. Published Application No. 2010/0138999 is based on a frame design and includes nodes which must support bending to prevent deformation.

The foldable litter shown in the examples of the invention preferably also includes a series of second truss structures lying in the lateral axis to support the patient's weight and resist applied torsional and shear loads. The nodes of these truss structures are held apart by a foldable compression bar and the patient is supported by a tensioned bed which is reacted by a lower tension element. The nodes are prevented from shearing by a pair of cross laced diagonal tension elements.

Figure 5:
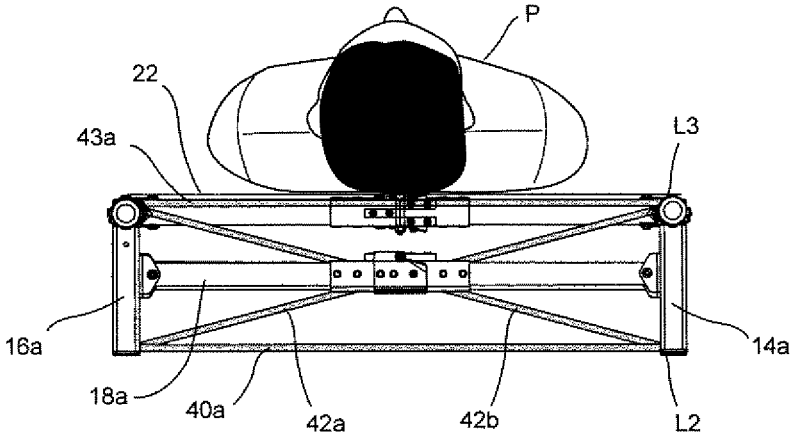
FIG. 5 is a schematic cross sectional end view showing a lateral truss structure in accordance with an example of the invention.

The example of the lateral truss structure shown in FIG. 5 includes opposing legs 14*a* and 16*a*, compression bar 18*a*, and flexible tension member 40 connecting across the litter to nodes at or proximate the bottom of opposing legs 14*a* and 16*a*, and diagonal flexible tension members 42*a* and 42*b* extending from the bottom nodes to the top nodes of the opposing legs. With three opposing legs, there are thus three lateral truss structures as more clearly shown in FIG. 3. The lateral truss structures may further include the bed and/or laterally extending flexible tension elements 43*a*, 43*b*, and 43*c*, FIGS. 2-3 connected between the top nodes of opposing legs and optionally sewn to the bed.

In sharp contrast, the designs of U.S. Pat. Nos. 3,555,578 and 2,360,371 include nodes which have to be made heavier to support bedding loads to prevent deformation. The design of U.S. Patent Publication 2010/0138999 includes cross brace elements which must support bending loads to prevent deformation.

Figure 6:
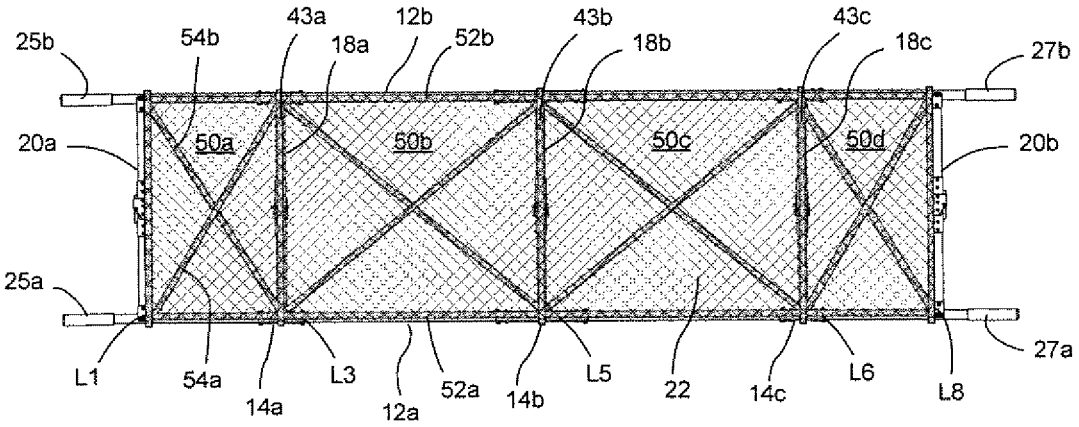
FIG. 6 is a schematic top view showing a bed or top truss structures of the litter.

One preferred foldable litter preferably also includes a top or bed truss structure including, as shown in FIG. 6, for each bed truss panel 50*a*, 50*b*, 50*c*, and 50*d*, a pair of spaced compression bars, a section of each longeron between the spaced compression bars, and flexible diagonal tension members. Accordingly, for bed panel 50*a*, the top truss structure includes compression bars 20*a* and 18*a*, longeron sections 52*a* and 52*b*, and flexible diagonal tension members 54*a* and 54*h* extending from the top of legs 14*a* and 16*a* diagonally across the bed to the intersection between longeron sections 52*a*, 52*b*, and bar 20*a*. Diagonal truss members 54*a* and 54*b* may be sewn to the bed. Bed panel 50 has a similar structure. For bed panels 50*b* and 50*c*, the diagonal tension members are connected to the longerons and/or the tops of the spaced legs.

The longitudinal side trusses are held apart by the lateral trusses and by the outer compression bars at either end. These compression elements react to the tension loads of the bed and the cross legs diagonal elements of the bed complete the truss structure to prevent shear during loading from both hand carrying and vehicle transport operations.

In sharp contrast, U.S. Pat. Nos. 3,555,578 and 2010/0138999 fail to include any diagonal elements and as a consequence the nodes have to be made heavier to support bending loads to prevent deformation. The structure shown in U.S. Pat. No. 2,360,371 fails to disclose a truss structure and the central nodes have to be made heavier to support bending loads to prevent deformation.

In addition to the use of truss structures, the subject invention also reduces structural mass required by transferring the patient's lateral and forward loads directly to the restraints holding the litter to the transport vehicle. The patient restraint shoulder straps preferably connect directly to the truss nodes at one end and the lap belt straps connect directly to nodes at the other end. The lap belt also connects directly to the nodes. Similarly, the ankle belt is anchored to the nodes. In this way, the patient lateral and forward/app accelerations during transportation are transmitted directly to the nodes of the litter truss structure. The tension lines of the litter restraint hold the litter down to a transport vehicle tie down point and also anchor directly to the same litter nodes as or very nearly as the same as the patient restraint harness. This arrangement results in a direct load transfer greatly reducing the structural loads that must be borne directly by the litter and also facilitates the load transfer through the truss structure.

Figure 7:
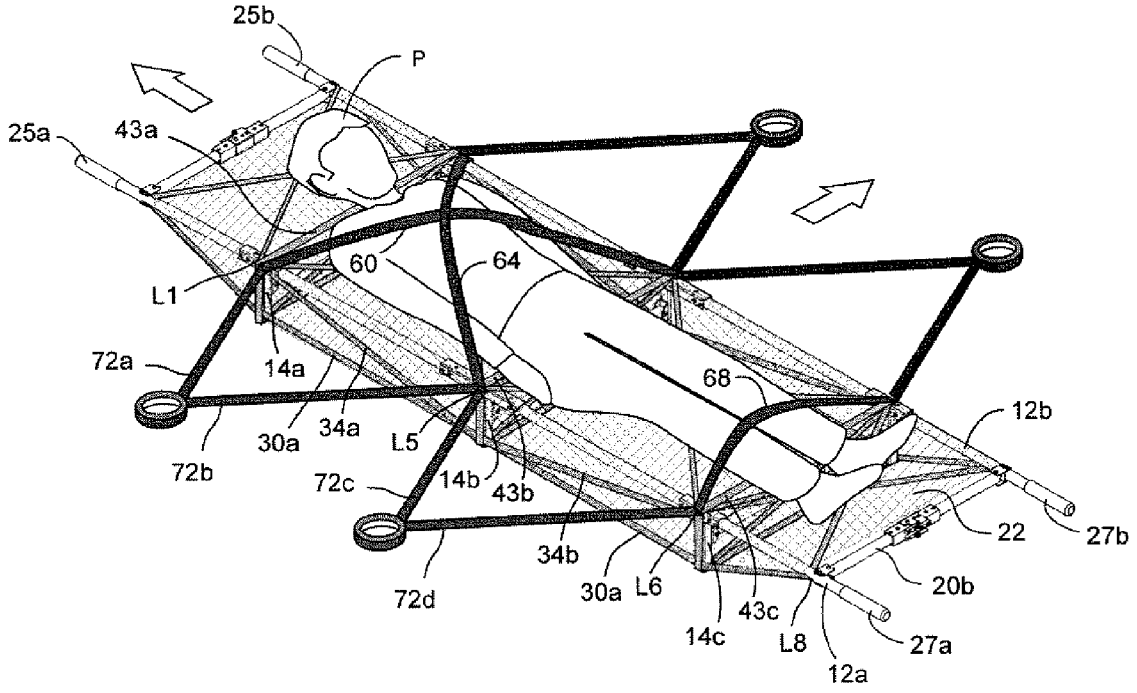
FIG. 7 is a schematic view showing a patient restrained to the litter itself restrained to a vehicle in accordance with examples of the invention.

Thus, in one particular example, shoulder strap 60, FIG. 7 connects to node $L_1$ of the top truss structure, lap strap 64 connects to node $L_5$, and leg strap 68 connects to node $L_6$. Litter restraint straps 72*a*, 72*b*, and 72*c*, and 72*d* connect to the same nodes. The same configuration exists on the other side of the litter. The applicable nodes may include buckles, rings, or the like for connection to the patient restraint and litter restraint straps. FIG. 1 shows how diagonal tension members 54 of the top truss structure form loops 69 for connection to the patient restraint and litter restraint straps, lines, or harnesses.

Figure 8A:
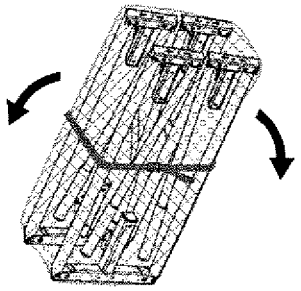
FIGS. 8A-8E shown the primary steps associated with deploying a litter in accordance with examples of the invention.
Figure 8B:
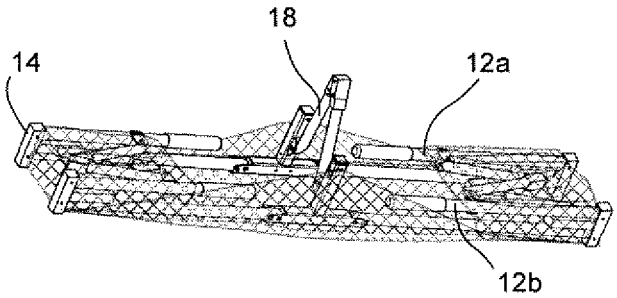
Figure 8C:
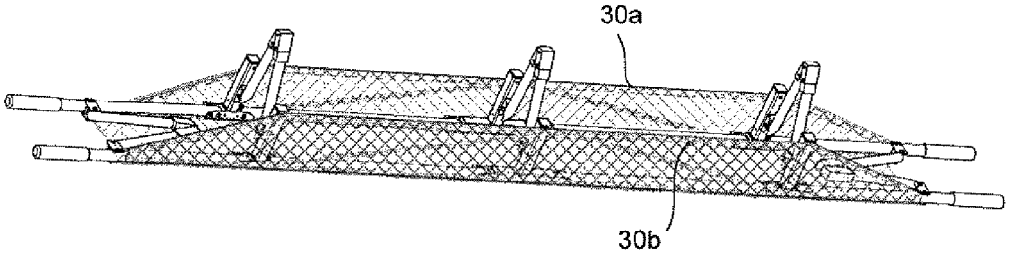
Figure 8D:
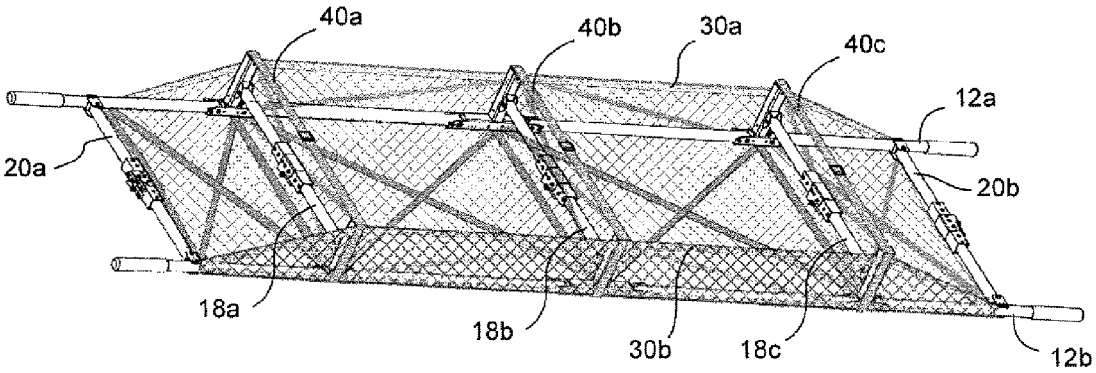
Figure 8E:
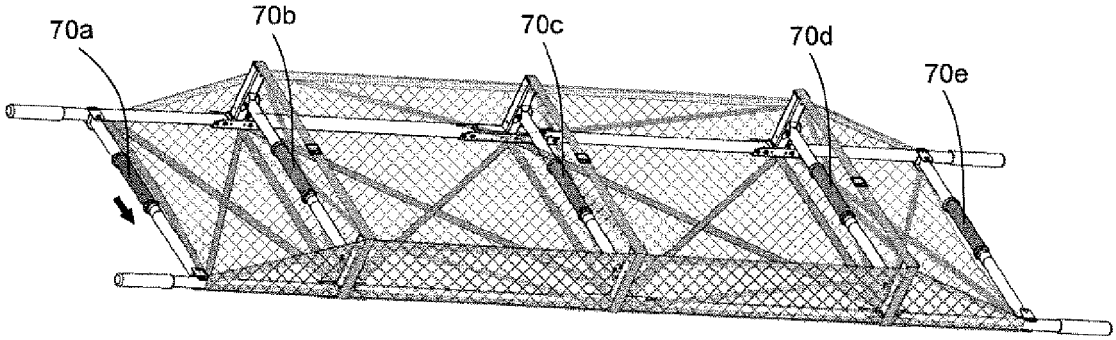

FIG. 8A shows a compact lightweight foldable litter in its packaged configuration. In FIG. 8B, the foldable longerons 12*a* and 12*b* are unfolded by pulling the handles away from each other until they reach the limit of travel by tensioning the lower flexible tension members 30*a* and 30*b*, FIG. 8C. FIG. 8D the spreader bars 20*a* and 20*b* and 18*a*-18*c* are unfolded until straight and locked in place tensioning the bed and the bottom tension cross straps 40*a* and 40*b* and 40*c* which may include adjustable buckles as shown. FIG. 8E shows a configuration where sliding tubes such as tubes 70*a*, 70*b*, 70*c*, 70*d*, and 70*e* are used to lock the spreader bars to prevent them from folding when the litter is loaded with a patient. Other latch mechanisms, locking mechanisms, and pivoting mechanisms are possible. The Kevlar fabric tension members may be fastened to the aluminum or metal alloy or composite tubular members (the longerons, legs, and spreader bars) using fasteners. The length of several of the various flexible fabric tension members may be adjusted using straps, buckles, and the like.

The result is unfoldable litter that forms a lightweight truss structure to support a patient's weight during normal transport and in the event of an accident with a transport vehicle.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A lightweight foldable patient litter comprising:

spaced compression longerons each foldable at first, second, and third spaced legs;

a bed between the compression longerons; and a longitudinal truss structure on each side of the litter including one of the compression longerons and a flexible, foldable tension member extending from at or proximate one end of said compression longeron to at or proximate the bottom of each leg to an opposing end of said compression longeron, the flexible, foldable tension members supporting loads only in tension and not supporting loads in compression or bending.

2. The litter of claim 1 in which each longitudinal truss structure further includes a diagonal flexible tension member between the second leg and the first leg and between the second leg and the third leg.

3. The litter of claim 2 in which the diagonal flexible tension members extend from at or proximate the bottom of the second leg to at or proximate the top of the first and third legs.

4. The litter of claim 1 further including one or more lateral truss structures between the spaced compression longerons and including an opposing pair of said legs.

5. The litter of claim 4 in which the lateral truss structure includes a foldable compression bar pivotably connected to each opposing leg, a flexible tension member extending from at or proximate the bottom of one leg across the litter to at or proximate the bottom of an opposing leg, and diagonal flexible tension members extending from at or proximate the bottom of one leg diagonally across to at or proximate the top of an opposing leg.

6. The litter of claim 5 in which the lateral truss structure further includes a flexible tension member extending from at or proximate the top of one leg across the litter to at or proximate the top of an opposing leg.

7. The litter of claim 4 in which there is a said-lateral truss structure between each opposing pair of said legs.

8. The litter of claim 1 further including a foldable compression bar pivotably connected between the spaced compression longerons on each end of the bed and also including bed truss panels between adjacent foldable compression bars.

9. The litter of claim 8 in which each panel includes flexible diagonal tension members.

10. The litter of claim 1 further including a handle on each end of the compression longeron extending beyond the bed.

11. The litter of claim 1 further including a patient restraint connected to nodes of a litter truss structure.

12. The litter of claim 11 further including a litter restraint connected to the same nodes.

13. A lightweight foldable patient litter comprising:

a longitudinal truss structure on each side of the litter including a foldable compression longeron, a plurality of legs, and flexible, foldable tension members extending from at or proximate one end of said compression longeron to at or proximate the bottom of each leg and then to an opposing end of said compression longeron; and one or more lateral truss structures between opposing legs of the litter;

the flexible, foldable tension members supporting loads only in tension and not supporting loads in compression or bending.

14. A lightweight flexible patient litter comprising:

spaced compression longerons each foldable at spaced legs;

a bed between the compression longerons;

a longitudinal truss structure on each side of the litter each including one of the compression longerons, its spaced legs, and one or more flexible, foldable tension members connected thereto;

one or more lateral truss structures between said spaced compression longerons and each including an opposing pair of said legs and one or more flexible, foldable tension members connected thereto; and bed truss panels including one or more tension members, the flexible, foldable tension members supporting loads only in tension and not supporting loads in compression or bending.

15. The litter of claim 14 in which each longitudinal truss structure includes a diagonal flexible tension members.

16. The litter of claim 14 in which said lateral truss structure further includes a foldable compression bar pivotably connected between opposing legs, a flexible tension member extending from at or proximate the bottom of one leg across the litter to at or proximate the bottom of an opposing leg, and diagonal flexible tension members extending from at or proximate the bottom of one leg diagonally across to at or proximate the top of an opposing leg.

17. The litter of claim 16 in which said lateral truss structure further includes a flexible tension member extending from at or proximate the top of one leg across the litter to at or proximate the top of an opposing leg.

18. The litter of claim 16 further including a foldable compression bar pivotably connected between the spaced compression longerons on each end of the bed.

19. The litter of claim 14 in which each panel includes flexible diagonal tension members.

20. The litter of claim 14 further including a patient restraint connected to nodes of a litter truss structure.

21. The litter of claim 20 further including a litter restraint connected to the same nodes.

22. A lightweight foldable patient litter comprising:

spaced compression longerons each foldable at spaced legs;

a bed between the compression longerons;

truss structures including flexible, foldable tension members supporting loads applied to the bed by a patient;

a patient restraint connected to nodes of the a truss structure; and a litter restraint connected to the same nodes;

the flexible, foldable tension members supporting loads only in tension and not supporting loads in compression or bending.

* * * * *